United States Patent [19]

Axtell

[11] Patent Number: 4,976,647

[45] Date of Patent: Dec. 11, 1990

[54] ERASABLE ANIMATED DRAWING BOARD

[76] Inventor: Stephen B. Axtell, 272 Dalton St., Ventura, Calif. 93003

[21] Appl. No.: 103,429

[22] Filed: Oct. 1, 1987

[51] Int. Cl.[5] ..... A63H 33/00; A63H 33/38; G09B 11/00; G09F 19/08

[52] U.S. Cl. ..... 446/151; 434/86; 40/421

[58] Field of Search ..... 446/146, 147, 149, 151, 446/152, 321, 337, 339, 341, 391; 434/85, 86, 90, 91, 92, 408; 40/416, 421, 425, 445, 491

[56] References Cited

U.S. PATENT DOCUMENTS

| | | | |
|---|---|---|---|
| 1,903,226 | 3/1933 | Perry | 40/491 |
| 2,367,373 | 1/1945 | Ralston | 446/151 |
| 2,476,742 | 7/1949 | Lareau et al. | 446/152 |
| 2,516,727 | 7/1950 | Schultheiss | 434/433 |
| 2,884,724 | 5/1959 | Lohnes et al. | 446/151 |
| 3,191,340 | 6/1965 | Jacobson et al. | 446/149 |
| 3,318,040 | 5/1967 | Kinberg | 446/151 |
| 3,416,231 | 12/1968 | Mercorelli | 446/146 X |
| 3,783,553 | 1/1974 | Goozner | 434/85 X |
| 3,863,386 | 2/1975 | Kinberg | 446/183 |
| 4,308,880 | 1/1982 | Graves | 446/339 X |
| 4,698,927 | 10/1987 | Yoshiro | 446/337 X |

FOREIGN PATENT DOCUMENTS

| | | | |
|---|---|---|---|
| 385643 | 1/1933 | United Kingdom | 434/90 |

*Primary Examiner*—Mickey Yu

*Attorney, Agent, or Firm*—Cassidy, Vance & Tarleton

[57] ABSTRACT

An animated drawing board includes a series of stacked sheets arranged in a common frame. The front sheet is a transparent panel having an erasable front surface. An opaque sheet having at least one aperture positioned in a predetermined position such as two apertures positioned at the location of the eyes of the figure to be drawn is disposed behind the transparent panel. A support sheet having a track guide aperture disposed behind the aperture is positioned behind the opaque sheet. A set of plates slightly larger than the track opening in the support sheet can be adhered to a track member slidingly received in the track guide aperture to form a slidable mount for a band of opaque material containing a feature of the figure such as an eyeball. A rear lever positioned to one side of the frame is attached to the rear plate of the slidable mount. After the user draws a facial figure, the user manually actuates the lever with his non-drawing hand to move the eyeballs on the band in front of the aperture to give the appearance of live animation. One or more resilient members can be provided for biasing one or both of the pupil bearing band and/or the mouth bearing band to a desired preset position.

2 Claims, 7 Drawing Sheets

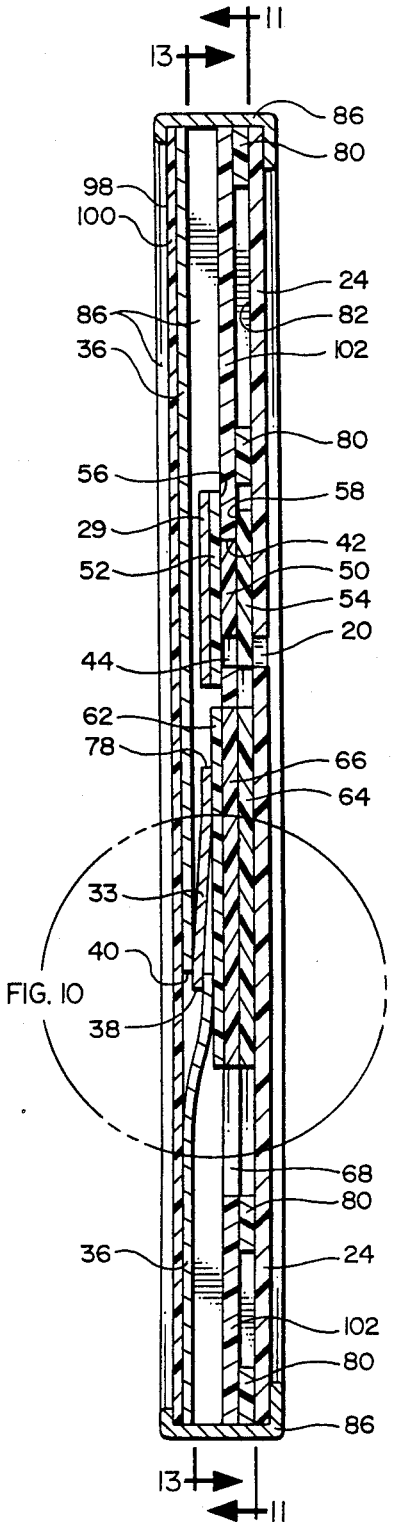
FIG. 9
FIG. 10
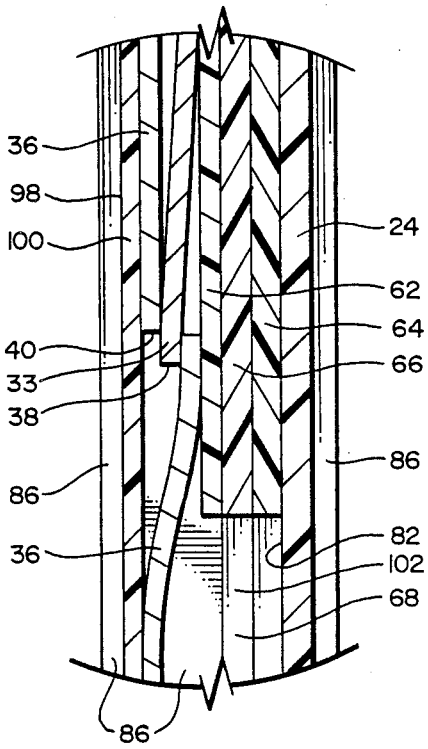

ERASABLE ANIMATED DRAWING BOARD

CROSS-REFERENCE TO DISCLOSURE DOCUMENT

This invention was disclosed in Disclosure Document No. 152222, filed June 24, 1986. It is requested that the Disclosure Document be preserved.

TECHNICAL FIELD

This invention relates to a drawing board and, more particularly, this invention relates to a drawing board having an erasable, transparent surface mounted over an opaque backing. Predrawn indicia such as facial features are moved onto the face of the backing to provide animation.

There are many three dimensional puppets with movable features. These devices are pre-manufactured in a set form and shape. The appearance of such devices is set and can not be changed. There are also many two-dimensional novelties with movable limbs or facial features. These novelties are found in greeting cards and some toys. Again, these novelties have a preset shape and decoration and cannot be changed in appearance except for the movability of the limbs or facial features.

There are many forms of easels that find use in educational, recreational or entertainment fields. Erasable easels find use in the classroom, business meetings and in various toys. There are felt-tip markers that dispense an ink that dries to form a line that is erasable by rubbing with a cloth or tissue. These markers are usually utilized on non-porous porcelain, glass, ceramic or synthetic resin surfaces such as polyvinyl acetate sheets. However, none of these easels or drawing boards contain transparent front surfaces or movable back surfaces.

LIST OF PRIOR REFERENCES

| U.S. Pat. No. | Patentee |
|---|---|
| 976,495 | P. Reeves |
| 1,124,639 | J. C. Mott |
| 1,419,136 | B. K. Hauck |
| 1,617,687 | M. J. Munson |
| 2,516,727 | R. A. Schultheiss |
| 2,859,552 | I. Bornstein |
| 3,191,340 | L. V. Jacobson et al |
| 3,228,742 | D. D. Hand |
| 3,318,040 | B. Kinberg |

DESCRIPTION OF THE PRIOR ART

Kinberg discloses a card toy with a transparent cellulose acetate top sheet 11. A figure with movable extremities is mounted in the frame. Bornstein's eyeglasses contain a transparent lens with a vibrating pupil mounted behind it. Jacobson displays a picture behind a transparent sheet. A picture on a rear sheet is rotated into view in a slot in a middle sheet. A picture is drawn by use of magnetic particles contained in the frame.

Mott discloses a novelty card with a separate oval sheet provided with a finger or thumb activator. Schultheiss discloses a light activated pad with a pencil or crayon erasable transparent cover sheets.

Munson, Hauck and Reeves, disclose flat card devices with movable features. Hand discloses a device composing cartoon frames comprising a series of registered opaque sheets with portions of upper sheets removed to expose underlying features on other sheets.

STATEMENT OF THE INVENTION

A new type of easel-puppet device is provided by the present invention. The drawing board of the invention includes a transparent, erasable easel mounted over an opaque backing having provision to deploy preprinted features into and out of the field of viewing. The user such as an artist, cartoonist, and particularly an entertainer, such as a magician, clown or ventriloquist, draws a face on the transparent surface with an erasable ink pen. He then manipulates a rear lever to move the pupils of the eyes and/or the mouth of the face. This causes the puppet to appear to be alive—a magical effect. The face can be erased with a cloth so that a new face can be drawn for a future performance.

The drawing board of the invention is a powerful communication tool. The movable eye and mouth features strongly command attention of the audience. Using the drawing board of the invention, an entertainer, artist or educator can create a normal drawing of a face on the surface of the drawing board. The illusion of the drawing appearing alive holds the attention of the audience permitting further communication with the audience and the dramatic, vivid presentation results in longer and more detailed retention of the experience in the memory of the audience.

The erasable, animated drawing board of the invention is a flat, self-contained, framed unit held in one hand. It does not require any set-up. The performer just begins drawing and then activates the animation of the hidden features. The audience can be invited to participate by drawing on the easel. Anything can be drawn on the easel. The device is easy to operate and can be used repeatedly by erasing the drawing on the surface. The drawing board is readily manufactured from available materials and can be operated reliably for many performances.

The drawing board of the invention is a stacked assembly of a plurality of flat members all held within a common frame. The drawing board includes a front sheet of transparent plastic such as polyvinyl acetate having an erasable front surface. An opaque second sheet having apertures is disposed behind the front sheet. A set of bands having the same color as the second sheet and containing features are slidably mounted behind the apertures so that the features are movable into view in the apertures. A rigid rear sheet contains means for mounting the track and the manual operating levers for operating the track.

These and many other features and attendant advantages of the invention will become apparent as the invention becomes better understood by reference to the following detailed description when considered in conjunction with the accompanying drawings.

BRIEF DESCRIPTION OF THE DRAWINGS

FIG. 9 is a cross-section taken on the line 9—9 of FIG. 3;

FIG. 10 is an enlarged view taken on the line 10 of FIG. 9;

DETAILED DESCRIPTION OF THE INVENTION

Figure 1:
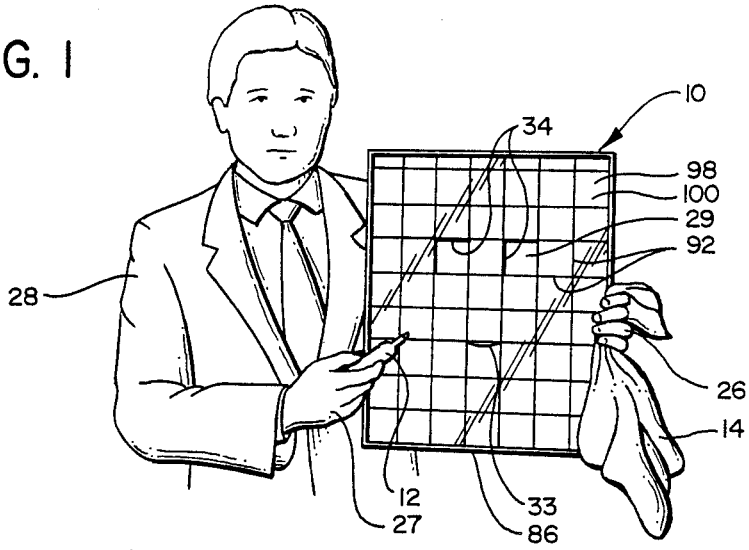
FIG. 1 is a front view of a drawing kit with implements.
Figure 2:
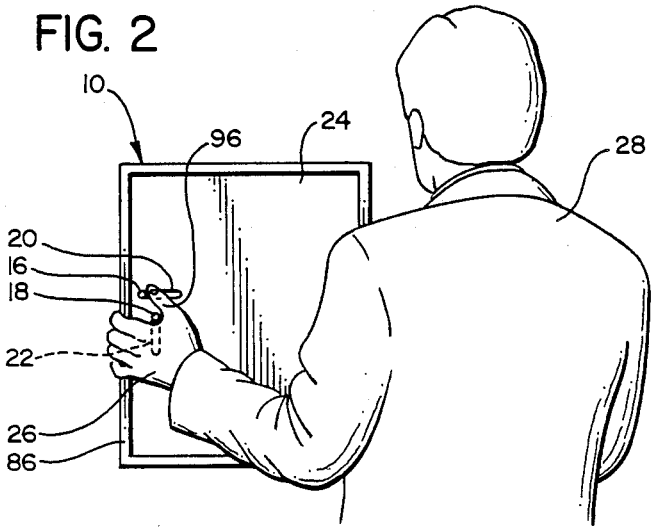
FIG. 2 is a rear view of FIG. 1.
Figure 4:
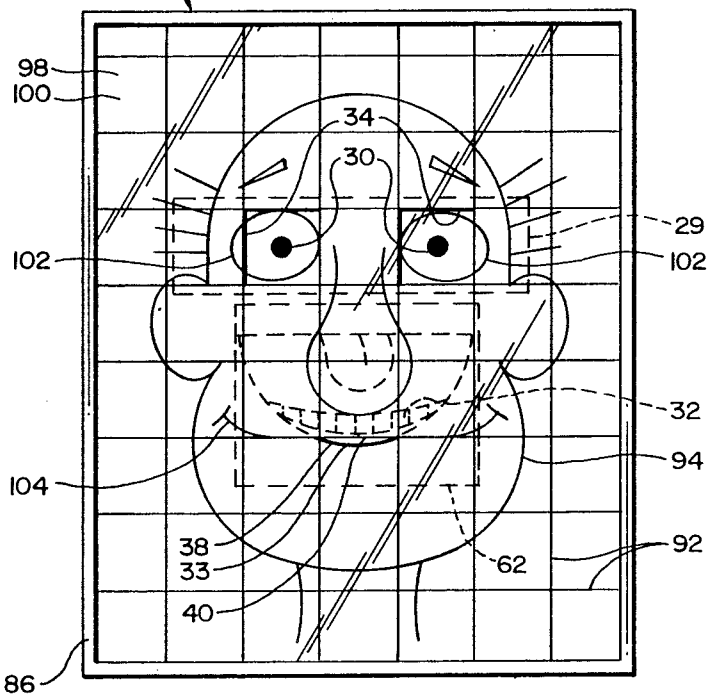
FIG. 4 is a front view with eyes shown.
Figure 3:
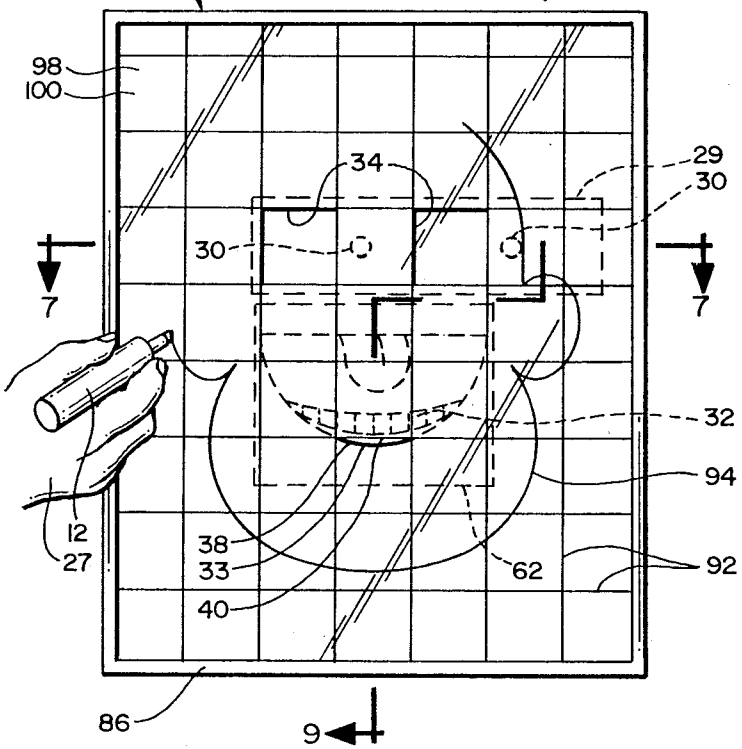
FIG. 3 is a front view with face being drawn.
Figure 6:
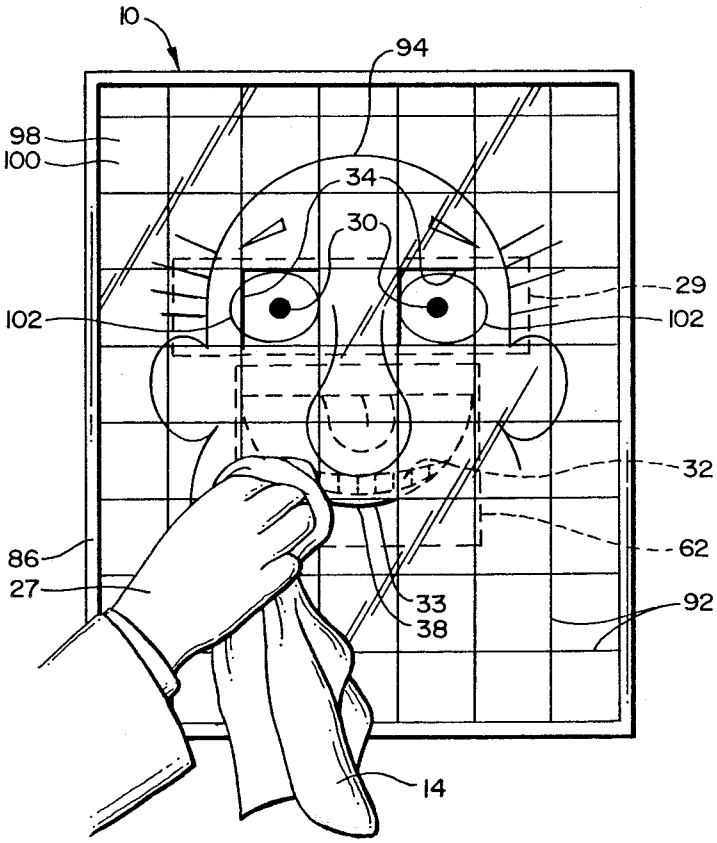
FIG. 6 is a front view showing face being erased with cloth.
Figure 5:
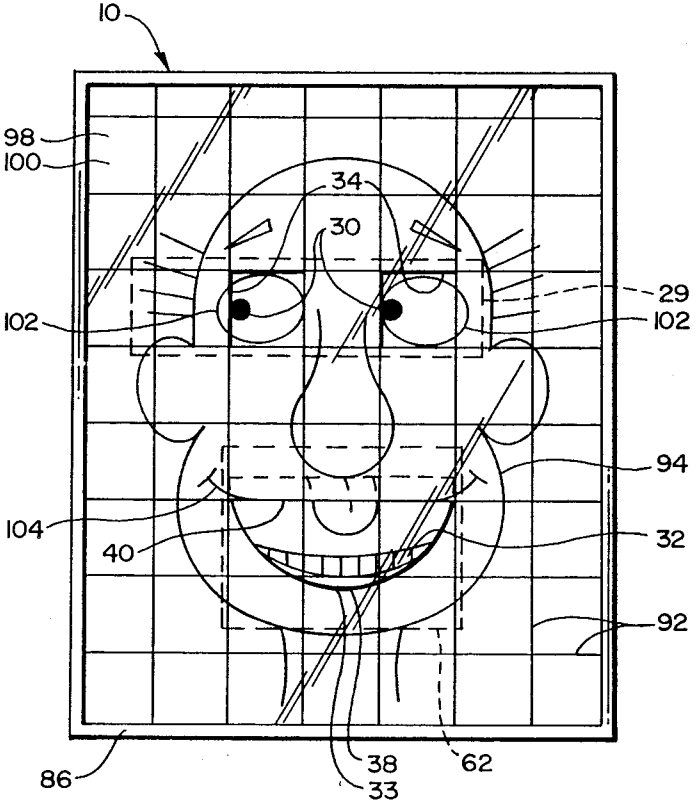
FIG. 5 is a front view with eyes moved to the left and mouth moved through slot.
Figure 7:
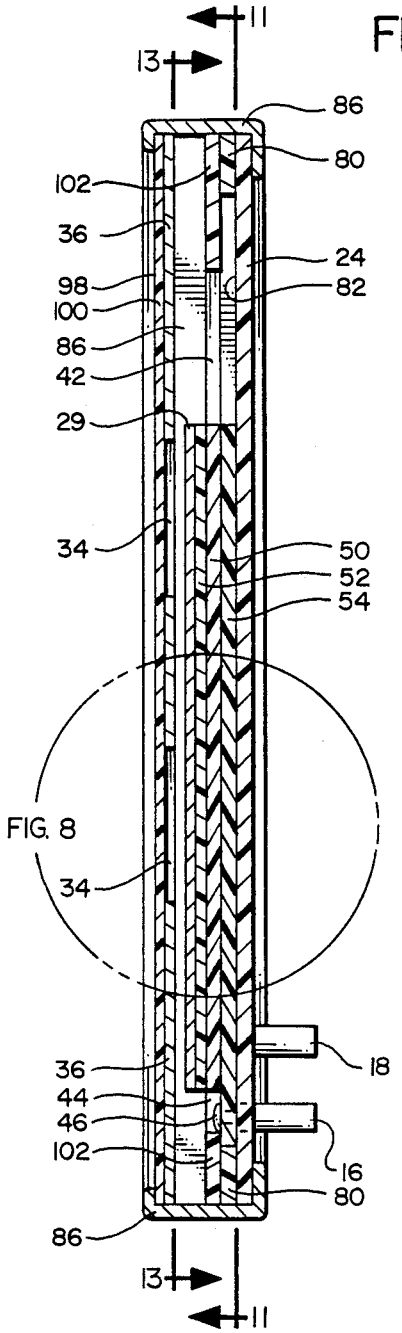
FIG. 7 is a cross-section taken on the line 7—7 of FIG. 3.
Figure 8:
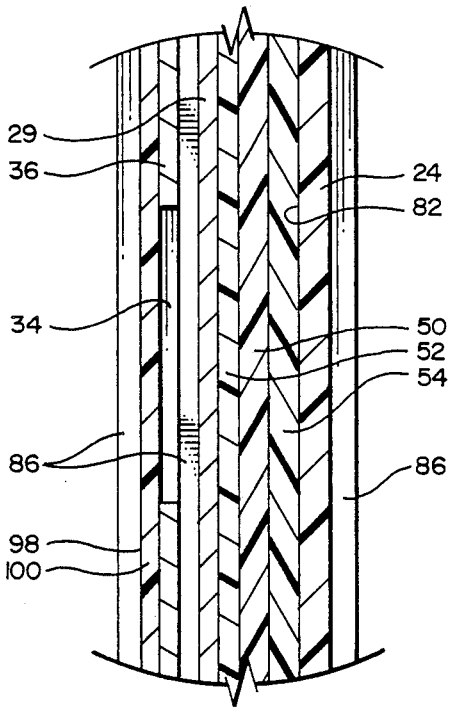
FIG. 8 is an enlarged view taken on the line 8 of FIG. 7.
Figure 12:
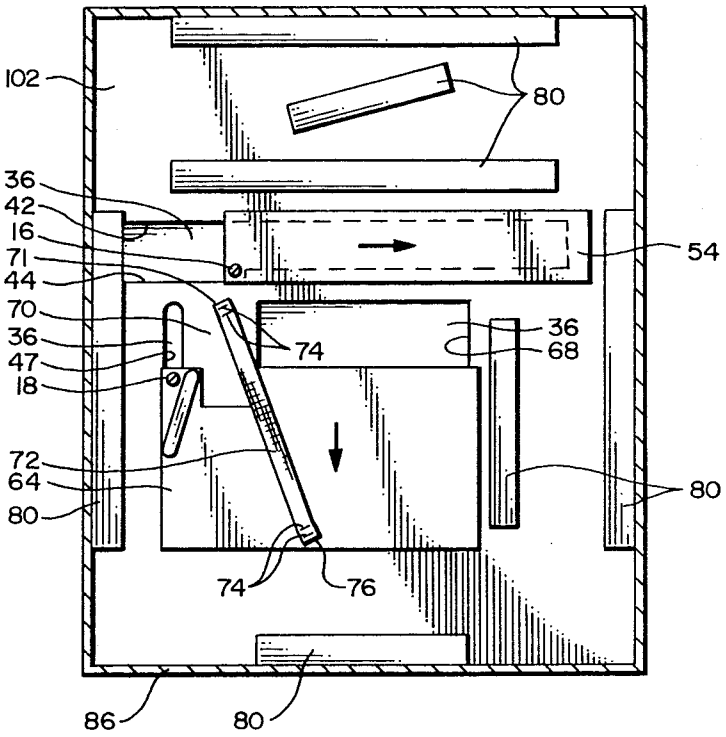
FIG. 12 is a view similar to FIG. 11 showing movement.
Figure 11:
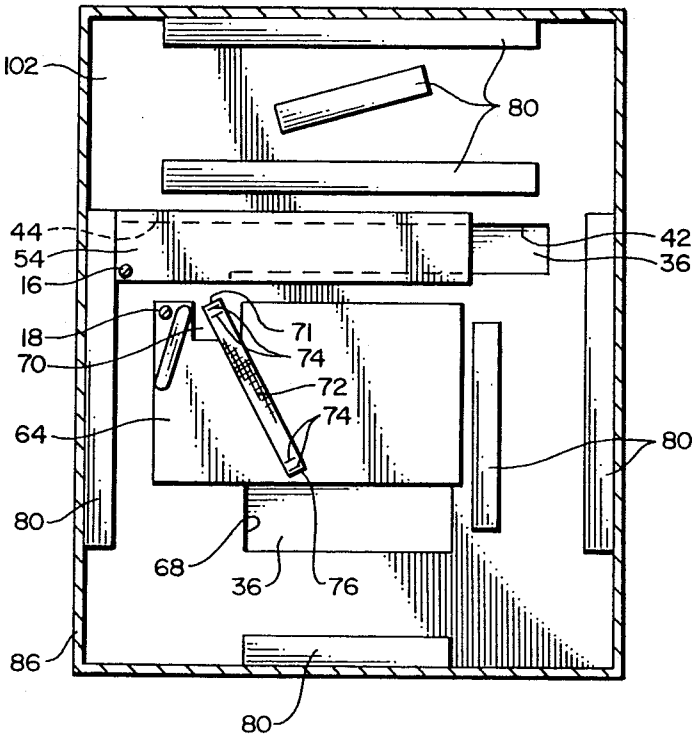
FIG. 11 is a view taken on the line 11—11 of FIG. 7.
Figure 14:
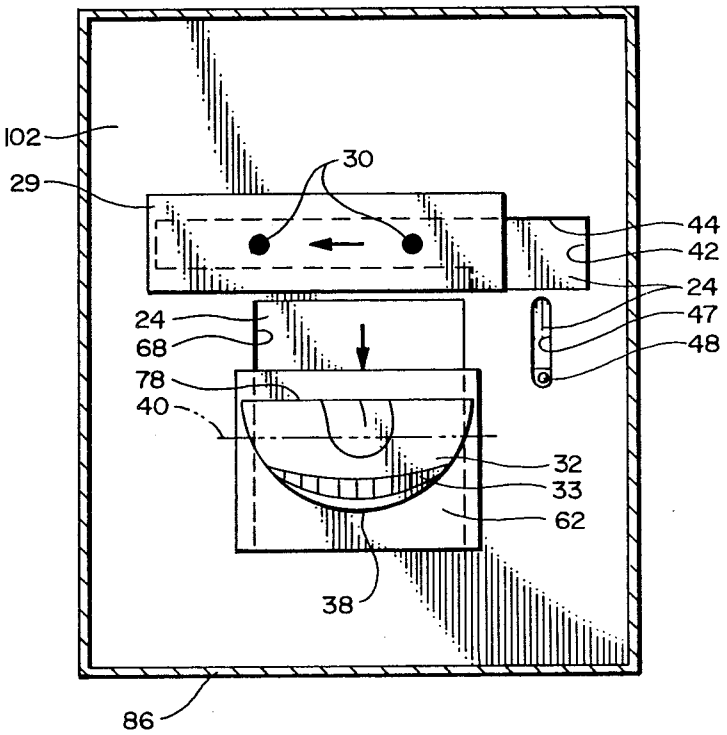
FIG. 14 is a view similar to FIG. 13 showing movement.
Figure 13:
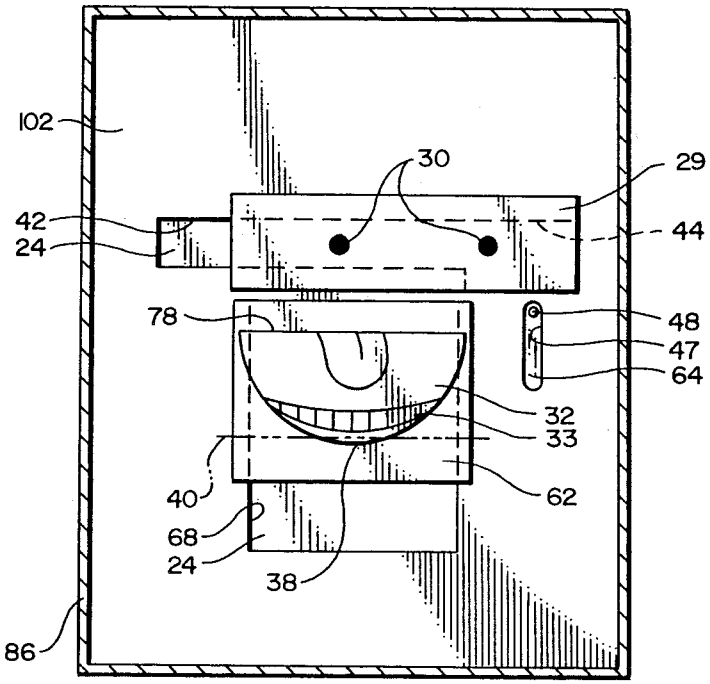
FIG. 13 is a view taken on the line 13—13 of FIG. 7.

The drawing board kit of the invention contains three items. As shown in FIG. 1, the kit contains a drawing board 10, a drawing implement 12, such as a felt tip pen dispensing an erasable ink, and a cloth 14 for erasing the pen markings. As shown in FIG. 2, a set of thumb levers 16, 18 are mounted through slots 20, 22 in the rear plate 24. The thumb levers are positioned to the side of the rear plate 24 that is adjacent the non-drawing hand 26 of the user 28. The levers are connected to bands that contain preprinted features such as a first band 29 containing a pair of horizontally spaced eyeballs pupils 30 and a second band 33 containing a mouth design 32. The first band 29 is the same material and color as the opaque backing sheet 36 so as to be invisible. The tip 38 of the second band 33 is also of the same color as the backing sheet 36 and extends slightly into a horizontal slit 40 in the backing sheet 36 but is not visible to view by the audience. The backing sheet may contain a pattern of grid lines 92 to aid in drawing a face.

As shown in FIGS. 3–6 the user 28 holds the drawing board 10 and eraser cloth 14 in his non-drawing hand 26 with his thumb 96 positioned on the levers 16, 18. He then draws a face FIG. 94 on the erasable surface 98 of the transparent, front panel 100 polyvinyl acetate using the grid lines as a guide for the placement of the eyes 102 and mouth line 104.

He then animates the figure by moving the eye lever 16 sideways to move the portion of the first band 29 containing the two horizontally spaced pupils 30 into view in a pair of horizontally spaced apertures 34 having the same center-to-center spacing as the pair of pupils 30 on the band 29, while moving the mouth lever 18 downwardly to move the second band 33 vertically downward into view through the slit 40. When the user is finished using the figure, the FIG. 94 is erased by use of the eraser cloth 14.

The structural details of the track mechanisms and drawing board assembly are shown in FIGS. 7–14. The tracks mechanisms include: (i) a first horizontally oriented track member 50 positioned within a first horizontally oriented guide opening 42 formed in a stiff guide sheet 102 and (ii), a second vertically oriented track member 66 positioned within a second guide opening 68 formed in sheet 102. Face plates are secured to both sides of the track members 50, 66 which ride in respective ones of the guide openings 42, 68. The guide sheet 102, track members 50, 66 and face plates are preferably formed of smooth, self-lubricating plastics such as polyethylene, polypropylene or Nylon. The indicia such as the pupils 30 can be printed onto the surface of the front face plate. Preferably a small sheet or band of the same material as the opaque backing plate is utilized to assure invisibility of the animation indicia materials.

The eye movement assembly includes a horizontal guide opening 42 having a leg 44 of increased height relative to the height of opening 42, such leg 44 being adjacent the edge at which the lever 16 is mounted to accommodate movement of the fastener 46 for the lever 16. Similarly, a slot 47 is provided in the guide sheet 102 for clearance of the mouth lever fastener 48.

The eye track is formed of a first track member 50 having the same thickness as the guide sheet 102 and, one may use simply a portion of the piece cut from the guide sheet to form the eyetrack guide opening 42. The first track member 50 is rectangular and does not contain a portion corresponding in height to the height of leg 44 of horizontal guide opening 42 so as to provide clearance for the fastener 46. The first track member 50 is adhered to a face plate 52 and a back plate 54 having dimensions slightly larger than the guide opening 42. The surfaces 56, 58 on each side of the track member 50 ride on the surface of the guide sheet 102 and lock the first track member 50 in place in the guide opening 42. The eye band 29 containing the pupils 30 is adhesively secured to the front surface 50 of the front face plate 52 and the lever 16 and fastener 46 are secured to the back face plate 54.

The mouth movement assembly also utilizes a face plate 62 and a back plate 64 secured to the second track member 66. The second track member 66 can again be formed from a portion of the piece cut out of the guide sheet 102 to form the mouth track guide opening 68. The second track member 66 may be mounted on the back plate 64 offset to the opposite side from the lever 18. This permits access to the surface 70 of the guide sheet 102 to mount one end 71 of a strip of elastic tape 72 with a staple fastener 74. The other end 76 of the tape 72 is attached toward the lower end of the back surface of the back plate 64.

The decorated mouth band 33 can be formed of stiffer material than the opaque backing sheet 36 since only the top edge 78 is secured to the front plate 62. The undecorated tip 38 penetrates the slit opening 40 in the backing sheet 36 and the curved, semi-circular mouth plate 33 moves through the opening 40 in front of the surface 94 of the backing sheet 36. A series of strips 80 are secured to the front surface 82 of the rear plate 24 to space the surface 82 from the back plates 54, 64 and from the elastic 72. The activator levers 16, 18 are received through the slots 20, 22 in the rear plate. The sheets and plates are assembled into a stack and are secured by frame members 86 to form the drawing board 10.

The drawing board can be formed of any appropriate materials such as paper, cardboard, metal, plastic or wood. The opaque backing sheet can be paper or plastic. The front, transparent plate can be plastic or glass. The apertures and slots can be placed in other positions and can be other shapes such as polygonal or round. The indicia printed on the front plate of the tracks need not be human facial features. The indicia can be animal features, limbs of a person or of an animal, houses or buildings, mountains or bodies of water. It all depends on the picture to be drawn by the user. The resilient member can be utilized to provide automatic return of the mouth plate or to provide self centering of the eyeplate. The resilient member can be rubber or a flatspring. It can also be used to add a vibrating effect of these facial features. The eye panel can be moved to take the eyeballs out of view while erasing the drawing to give the effect that the eyes are also erased. The aperture cut outs may tend to form shadows under certain lighting conditions. This can be avoided by pressing your thumb against the back of the board next to the top lever or between the two eye apertures. Erasure of the surface can be provided by a conventional chalk eraser instead of a cloth.

It is to be realized that only preferred embodiments of the invention have been described and that numerous substitutions, modifications and alterations are permissible without departing from the spirit and scope of the invention as defined in the following claims.

We claim:

1. An animated drawing board comprising in combination:

a front transparent panel formed of synthetic organic plastic having an erasable surface;

an opaque sheet having a pair of horizontally spaced apertures fixedly disposed behind said front panel;

a first horizontally oriented track member mounted behind said first pair of apertures;

a first band slidable received in said first track member having an opaque front surface with preprinted indicia mounted on an area of said front surface of said band;

said opaque sheet having a third aperture comprising a horizontal slit formed therein;

a second vertically oriented track member mounted behind said third aperture;

a second band slidably received in said second track member for movement through said third aperture in front of said opaque sheet, said second band having indicia in the form of a mouth formed on the front face thereof;

a back plate supporting said first track member behind said first pair of aperture and said second track member behind said third aperture;

actuating means for moving said first and second bands; and frame means for holding said panel, said opaque sheet, said back plate, and said first and second track members together as a stacked assembly.

2. An animated drawing board according to claim 1 in which a leading undecorated tip of said second band is disposed in said third aperture in its initial position.

* * * * *